United States Patent [19]

Williams et al.

[11] 4,394,057

[45] Jul. 19, 1983

[54] DOUBLE-MOLDED ELECTRICAL END FITTING ASSEMBLY

[75] Inventors: James Williams, Abbeville; Henry K. Wills, Greenwood, both of S.C.

[73] Assignee: Automation Industries, Inc., Greenwich, Conn.

[21] Appl. No.: 254,435

[22] Filed: Apr. 15, 1981

[51] Int. Cl.[3] ..... H01R 35/00

[52] U.S. Cl. ..... 339/15; 339/28

[58] Field of Search ..... 339/218 R, 218 M, 15, 339/16, 28

[56] References Cited

U.S. PATENT DOCUMENTS 3,093,434 6/1963 Francis ..... 339/218 R 4,063,790 12/1977 Kleykamp et al. ..... 339/16 R

*Primary Examiner*—Eugene F. Desmond

*Assistant Examiner*—David Pirlot

*Attorney, Agent, or Firm*—Francis N. Carten

[57] ABSTRACT

An electrical end fitting assembly for a flexible hose having a pair of electrical conductors extending throughout its length wherein molded male and female plug connectors are in turn molded within an enveloping fitting to provide a double-molded assembly.

2 Claims, 7 Drawing Figures

10
11
12
13
14
15
16
17
18
19
20
21
22
23
24
25
26
27
28
29
30
31

DOUBLE-MOLDED ELECTRICAL END FITTING ASSEMBLY

BACKGROUND OF THE INVENTION

Vacuum hose end fittings commonly consist of a single molded matrix surrounding the end portions of the hose and typical examples are shown in U.S. Pat. Nos. 3,928,715, 4,012,091, 4,018,493 and 4,063,790. The end portions of such hoses are prepared by exposing the conductive wires within the jacket of the hose, and the wires are then connected to female receptacles or male connectors. A supporting core is then inserted in each end of the hose and an injection molded configuration is formed around each of the connectors. A suitable electric harness is connected to the male or female plug at each end of the hose for completing the circuit of the vacuum cleaner system. It is characteristic of the prior art that the end fittings are formed in a single-stage molding process.

The principal purpose of the present invention is to provide a double-stage concept of molded end fitting connectors wherein the conductive wires of the connectors are not in direct contact with the material that comprises the main outer structure of the end fitting. This is of significance because connector wires can and do move within hose end fittings and the double-stage process of the invention safeguards against unintentional grounding or short-circuiting of the wires. In addition the double-stage process permits the electrically insulated connectors to be inspected for dielectric integrity before incorporation into the remainder of the end fitting. A further feature of the double-molded concept of the invention is that it permits the connectors to be molded with their own insulation at a much higher injection pressure that would be permissible with the remainder of the end fitting attached to the helically fabricated hose end portion, and this assures that voids are not created in the molded material immediately around the conductive wires.

STATEMENT OF THE INVENTION

A double-molded electrical end fitting assembly is provided by the invention for a flexible hose having a pair of electrical conductors extending throughout its length. The end fitting assembly includes a dual-wire connector with molded male and female plugs at its opposite ends. One of these plugs is connected electrically to the electrical conductors of the hose at one end portion of the hose. The entire dual-wire connector and the hose end portion are enclosed within a molded fitting in a manner such that the other of the plugs is accessible within a recess at the extremity of the molded fitting.

Figures 1, 2, 3, 4:
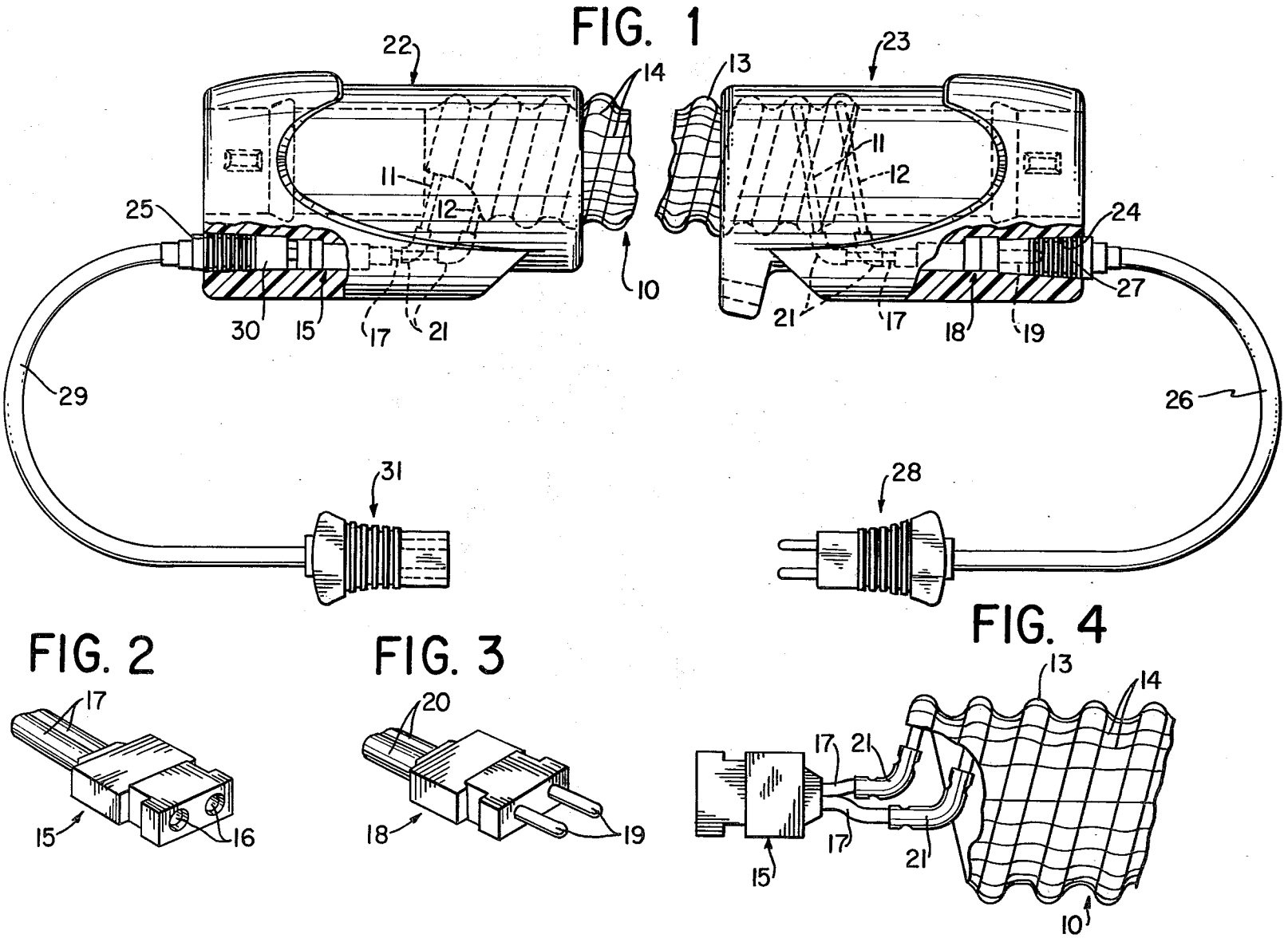
FIG. 1 is a fragmentary elevation partly in section showing a flexible hose equipped with one of the double-molded electrical end fitting assemblies of the invention at each of its ends.
FIG. 2 is a perspective view of the female form of the dual-wire connector of the assembly.
FIG. 3 is a perspective view of the male form of the dual-wire connector of the assembly.
FIG. 4 is a sub-assembly of the female connector attached to one end portion of the hose.
Figure 5:
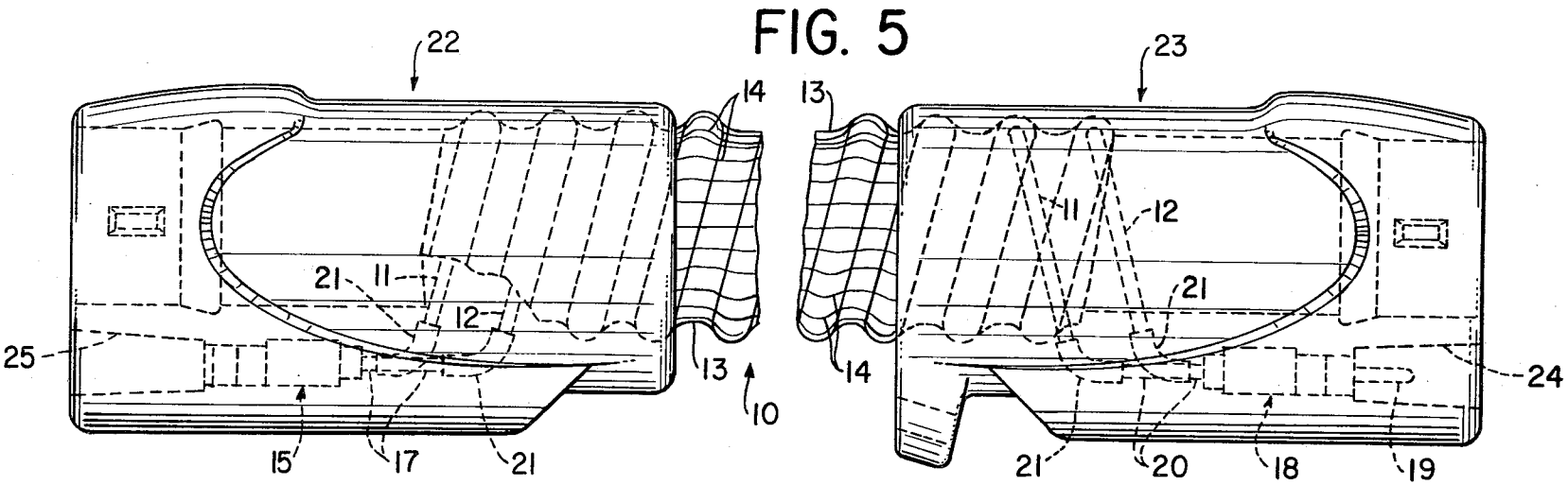
FIG. 5 is a fragmentary elevation of the hose with the molded fittings in place.

Referring first to FIGS. 1, 4 and 5, the end fitting assembly of the invention is shown in conjunction with a dual-wire electrical hose 10 which itself is described in detail in U.S. Pat. No. 4,224,463. Such a hose is advantageously formed on a continuously advancing mandrel device as shown in U.S. Pat. No. 3,155,559. A pair of insulated wires 11 and 12 are helically arranged within a multi-layer plastic wire jacket 13 reinforced with cords 14.

The double-molded electrical end fitting assembly of the invention is formed in two stages of molding, the first of which involves the formation of a pair of electrical plug connectors, female and male, as shown in FIGS. 2 and 3 respectively. These connectors are formed by techniques well known in the prior art, involving the trimming and stripping of a pair of wires, associating them with appropriate hardware, and placing the wire with those attachments in a mold cavity. A thermoplastic is injected into the cavity at high pressure to enclose the connection with a homogeneous mass of insulating thermoplastic. In this manner the female connector 15 of FIG. 2 is formed with appropriate receptacles 16 and dual insulated wires 17. Likewise, a male connector 18 as shown in FIG. 3 is formed with appropriate plugs 19 and dual insulated wires 20. By separately molding these subassemblies they may be completely enclosed within a high-strength steel mold during the injection process so as to allow "packing" to occur during the latter phases of the injection cycle. This insures development of the optimum properties of the thermoplastic such as tensile strength and density, and prevents formation of voids which could compromise the mechanical and electrical properties of the body of the connector.

In FIG. 4 the attachment of the female connector 15 to one end of the hose 10 is shown. It should be understood that the male connection 18 is similarly attached to the other end of the hose 10 as illustrated in dotted lines in both FIGS. 1 and 5. This attachment is made by trimming the hose 10 to its desired length and exposing the metal wires of the helix. The wires are then bent to an orientation approximately parallel to the centerline of the hose as shown in FIG. 4, and the stripped wires 17 (or 20 as the case may be) are joined to the wires of the hose by solderless connectors 21 which are crimped in place to make the mechanical and electrical connection.

A metal mold core is then placed within the inside of the hose end portion so that connector 15 (or 18) is properly aligned therewithin. The mold is then closed and molten thermoplastic is injected to encase the entire connector together with the hose end portion and associated elements in a second insulated body or outer molded fitting 22 (or 23 in regard to the male connector 18) as shown in FIG. 5.

Referring to the end of the assembly with the female connector 15, on the left as seen in FIG. 5, the molded fitting 22 is shaped with a recess 25 at its outer extremity to which the receptacles 16 of the female connector 15 are accessible. Likewise at the other end of the hose a recess 24 is formed to which the plugs 19 of the male connector 18 are accessible. In most installations, and particularly when used on vacuum cleaners, the hose assembly requires the use of replaceable harnesses and a pair of them are shown individually in FIGS. 6 and 7 and in combination with the remaining elements in FIG. 1. The harness 26 shown in FIG. 6 includes a molded female end 27 which is designed to fit within the recess 24 to make a tamper-proof tight connection with the plugs 19 of the male connector 18. A conventional male end 28 for attachment to a socket receptacle is included at the other end of the harness 26. Similarly, as shown in FIGS. 1 and 7, an opposite form of harness 29 is formed with a molded male end 30 designed to be inserted tightly and in a tamper-proof fashion within the recess 25 for connection to the receptacle 16 of the female connector 15. At the other end of the harness 29 is a conventional female end 31.

It will be noted that reversal of the male and female harnesses cannot result in any electrical connection because the recesses 24 and 25 can receive only the ends 27 and 30 respectively. Thus a potential hazard from improper use is precluded. Moreover the well known male and female correspondence of the opposite ends of the harness is maintained, and since this standard relationship is well known to the public, the degree of instruction required to facilitate proper use is minimal.

In a typical vacuum cleaner hose assembly, such as one with a motorized sweeper attachment, the female molded end fitting 15 of FIG. 2 is the only electrical connection of the assembly that is accessible in any way in the energized state, as is the case with all common extension cords, and these energized receptacles 16 are doubly recessed within the contours of the fitting 22. This is an important safety advantage which virtually eliminates any possible contact with electrically charged components.

Figure 6:
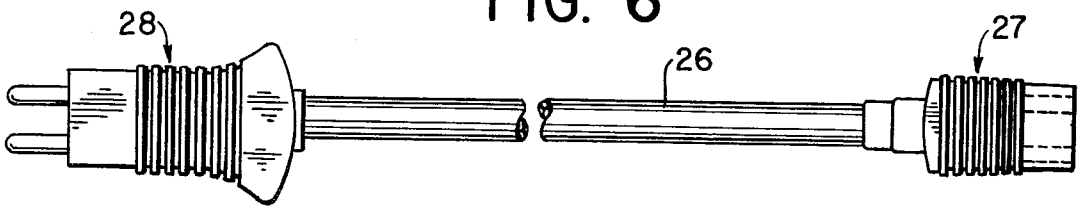
FIG. 6 is a fragmentary plan view of a form of harness with male connecting means for use in the assembly.
Figure 7:
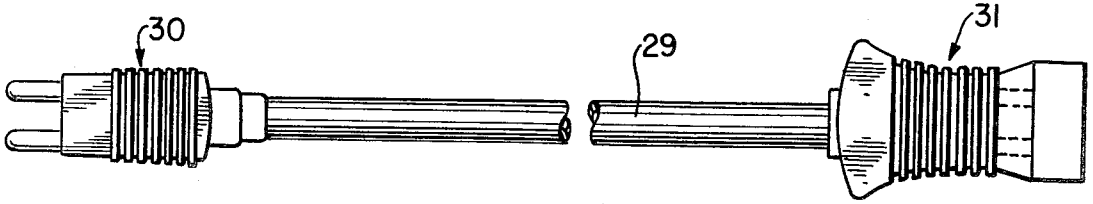
FIG. 7 is a fragmentary plan view of a form of harness with female connecting means for use in the assembly.

As seen in FIGS. 6 and 7 the ends 27 and 30 are tapered in the direction of their insertion into the corresponding recesses 24 and 25 and may be fitted with lands as shown to provide a good wedge fit. This allows intentional disconnection of the harnesses without special tools and is an important safeguard against inadvertent disconnection.

Because the assembly is made in a two-stage molding process, the inner molded connectors 15 and 18 can be made by a high pressure injection technique to give maximum integrity whereas the outer molded fittings 22 and 23 can be injected at lesser pressure to avoid damage to the hose structure itself. Thus an acceptable degree of properties is limited to the outer fittings 22 and 23 which cannot withstand high pressure injection, while the optimum properties are limited to the inner connectors 15 and 18 which can be made at high injection pressure.

Another advantage of the double-molded concept of the invention is that electrical tests for dielectric integrity can be made on the inner connectors 15 and 18 without involving the entire assembly which is cumbersome and not suitable for typical testing situations.

We claim:

1. In combination with a flexible hose having a pair of electrical conductors extending throughout its length, a first outer fitting molded about one end of the hose and having a first recess at its extremity, a first removable electrical harness having a male connector end insertable in the first recess of the first molded fitting, a second outer fitting molded about the other end of the hose and having a second recess at its extremity, a second removable electrical harness having a female connector end insertable in the second recess of the second molded fitting, the improvement which comprises:

(a) a female connector with dual insulated wires molded and enclosed entirely within the first outer fitting, a female plug being included therein and accessible within the first recess of the first outer fitting to receive the male connector of the first harness, said dual wires being electrically connected to said pair of electrical conductors of the hose; and (b) a male connector with dual insulated wires molded and enclosed entirely within the second outer fitting, a male plug being included therein and accessible within the second recess of the second outer fitting to receive the female connector of the second harness, said dual wires being electrically connected to said pair of electrical conductors of the hose.

2. A combination according to claim 1 wherein the first and second outer fittings and the male and female connectors are injection molded of thermoplastic material.

* * * * *